US006702011B2

(12) United States Patent
Crawford et al.

(10) Patent No.: US 6,702,011 B2
(45) Date of Patent: Mar. 9, 2004

(54) COMBINED NITROGEN TREATMENT SYSTEM AND COILED TUBING SYSTEM IN ONE TRACTOR/TRAILER APPARATUS

(76) Inventors: James B. Crawford, 407 Phoenix Dr., Lafayette, LA (US) 70503; Edward R. Lamb, 107 Hawthorne, Lafayette, LA (US) 70508

( * ) Notice: Subject to any disclaimer, the term of this patent is extended or adjusted under 35 U.S.C. 154(b) by 0 days.

(21) Appl. No.: 10/127,092

(22) Filed: Apr. 22, 2002

(65) Prior Publication Data

US 2003/0196793 A1 Oct. 23, 2003

(51) Int. Cl.[7] ..... E21B 19/22
(52) U.S. Cl. ..... 166/77.2; 166/90.1
(58) Field of Search ..... 166/77.2, 77.3, 166/85.1, 90.1

(56) References Cited

U.S. PATENT DOCUMENTS 4,585,061 A * 4/1986 Lyons, Jr. et al. ..... 166/77
6,230,805 B1 * 5/2001 Vercaemer et al. ..... 166/300
6,264,128 B1 * 7/2001 Shampine et al. ..... 242/397.3
6,273,188 B1 * 8/2001 McCafferty et al. ..... 166/77.2

* cited by examiner

*Primary Examiner*—William Neuder
(74) *Attorney, Agent, or Firm*—The Matthews Firm

(57) ABSTRACT

A single tractor unit is provided for pulling a tractor, in which the tractor itself drives a plurality of hydraulic motors which control a crane unit, a coiled tubing injection unit, and the pumps and motors associated with a liquid nitrogen system which is used for injecting gaseous hydrogen into a workover well with coiled tubing. In an alternative mode, the liquid nitrogen system is replaced with one or more nitrogen generators which gather nitrogen from the earth's atmosphere to be pumped through the coiled tubing into the well being treated. Alternatively, the gaseous nitrogen source is one or more tanks of compressed nitrogen gas.

11 Claims, 6 Drawing Sheets

COMBINED NITROGEN TREATMENT SYSTEM AND COILED TUBING SYSTEM IN ONE TRACTOR/TRAILER APPARATUS

FIELD

This invention relates, generally, to the treatment of oil and gas wells using nitrogen to increase the production capability of the wells, and specifically, to providing on a single tractor/trailer combination, all of the equipment accessories to pump nitrogen through a coiled tubing into the wells being treated.

BACKGROUND OF THE INVENTION

It is known in the art to provide work over operations using gaseous nitrogen to remove sand and/or water or other impediments to production. The prior art has not recognized that a single tractor trailer unit can be provided with all of the equipment and accessories for running a nitrogen service in combination with a coiled tubing unit to treat such wells. The prior art typically brings two tractor trailer assemblies to the well to be treated, one having a coiled tubing unit, and one having the nitrogen unit. Because of the duplicity of the tractor trailer units, this has caused a doubling of the transportation costs, a doubling of the personnel required to have the units arrive at the well, and a doubling of the number of personnel required to run this service.

It is of the primary object of this present invention to provide a combined tractor trailer unit which utilizes a single tractor and a single trailer to provide a service for treating wells with a combined tractor trailer unit through which gaseous nitrogen can be pumped.

DETAILED DESCRIPTION OF THE PREFERRED MODE OF THE INVENTION

Figure 1:
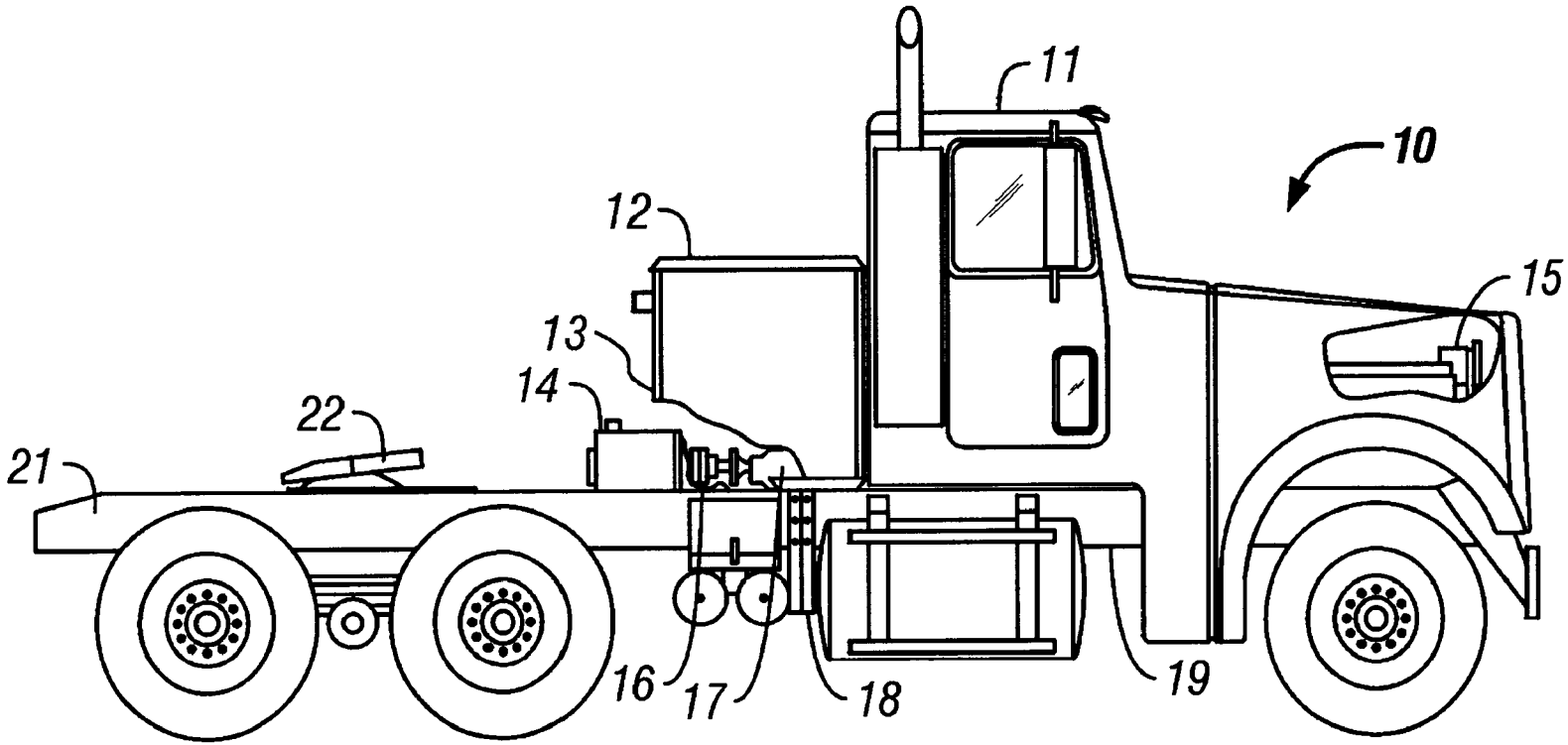
FIG. 1 is an elevated, schematic view of a tractor unit which can be used in accordance with the present invention.
Figure 2:
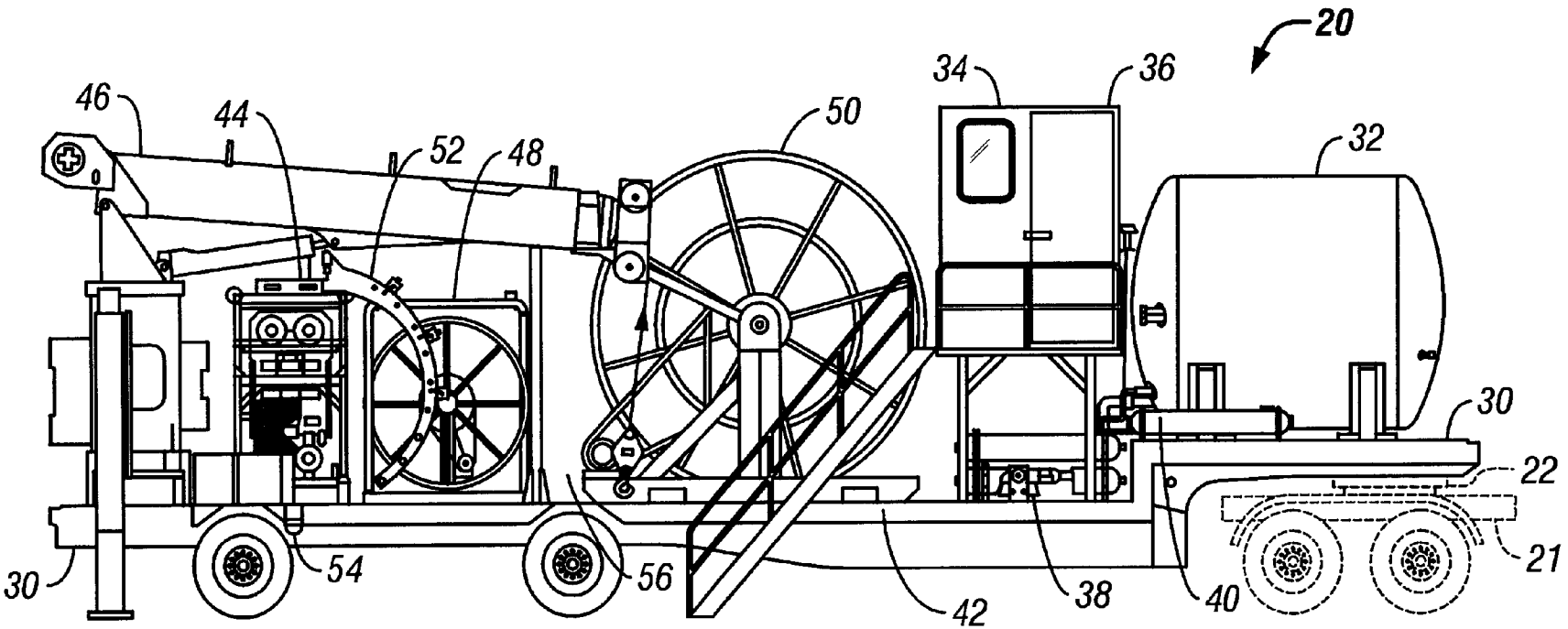
FIG. 2 is an elevated, pictorial view of a trailer unit which can be used in accordance with the present invention with the tractor illustrated in FIG. 1.

Referring now to FIG. 1, a tractor 10 having either a gasoline engine or a diesel engine is illustrated and which is used to pull the trailer 20 illustrated in FIG. 2 and which also uses its engine to drive all of the components which are illustrated in FIG. 1. and FIG. 2, on the tractor 10, and the trailer 20, respectively. The chassis 11 of the tractor 10 may be, for example, a Freightliner. The tractor 10 also has a hydraulic tank 12 and a tank holddown unit 13 which secures the hydraulic tank to the chassis. A hydraulic pump

14 has a coupling and a drive mechanism connected to its one end. The coupling 16 is connected into a transfer case and drive shaft mechanism 17. A hydraulic pump 18 is one of many hydraulic pumps in the tractor assembly 10 and also includes various hydraulic pumps within the assembly 19. It should be appreciated that all of the mechanisms illustrated with the tractor 20 in FIG. 2 are driven by hydraulic pumps located on the tractor chassis 10. The assembly 15 is a hydraulic pump which includes a clutch pulley being driven by the engine located within the tractor 10. The tractor bed 21 has an assembly 22 which is used to connect the tractor to the trailer as illustrated in FIG. 2.

Referring now to FIG. 2 in more detail, mounted on the trailer bed 30 which is connected to the tractor bed 21 by way of the mechanism 22, is a cryogenic nitrogen tank 32. As is well known in this art, liquid nitrogen has a greatly reduced volume compared to the volume of gaseous nitrogen. Nitrogen, when frozen to −320° F., is a liquid and accordingly, it is much preferred to transport the liquid nitrogen to the well site to provide additional volume of nitrogen gas which is to be pumped into the well. Also mounted on the tractor bed 30 is a control cabin 34 in which the electrical and hydraulic units 36 are controlled by a human operator. The nitrogen system 38 which is described in more detail hereinafter is also located on the tractor bed as is a heat exchanger 40 which is used to heat up the pumped liquid nitrogen to a temperature which causes the liquid to become gaseous, which can then be pumped into the well. The piping system 42 enables the gaseous nitrogen to be pumped into one end of the coiled tubing to allow the gaseous nitrogen to be pumped out of the other end of the coiled tubing.

An injector unit 44, also described in more detail hereinafter, is situated on the tractor bed floor. A hydraulically driven crane 46 is also situated on the tractor bed floor for situating the coiled tubing injector 44 immediately above the well being treated. A hose reel 48 and a coiled tubing reel 50 are also situated on the tractor floor. A goose neck 52 is also situated on the tractor floor adjacent the coiled tubing injector system 44 for feeding the coiled tubing from the reel into the injector. A stripper 54 is located on the lower end of the coiled tubing injector system 44 for enabling the coiled tubing to be placed into the well being treated. A BOP unit 56 is also located on the tractor floor to be used in shutting in the well to be treated, if needed.

Figure 3:
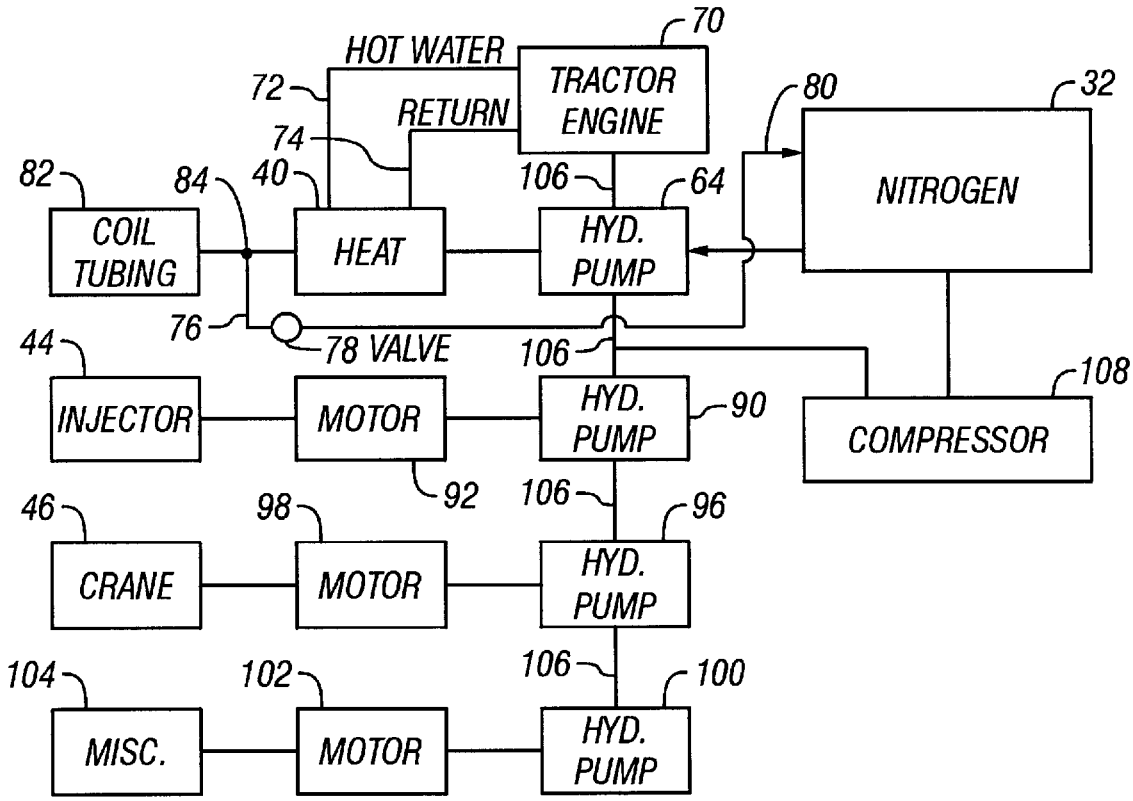
FIG. 3 illustrates, in block diagram, the various systems which are used in accordance with the present invention to treat a well with nitrogen.

Referring now to FIG. 3, there is illustrated in block diagram some of the components which are illustrated in FIGS. 1 and 2. The liquid nitrogen tank 32 has its output connected into the input of a hydraulic pump 64 whose output is connected into the input of the heat exchanger 40 illustrated in FIG. 2. The tractor engine 70, which may be either gasoline powered or diesel powered has a hot water line 72 connected to its radiator and which provides hot water to the heat exchanger 40. A return line 74 from the heat exchanger returns the water from the heat exchanger back into the radiator of the tractor engine 70. The pump 64 is designed to pump the liquid nitrogen having a temperature near −320° F. into the input of the heat exchanger 40. Such pumps are commonly available in the industry for pumping liquid nitrogen. As the liquid nitrogen is pumped through the heat exchanger 40, the heat exchanger will cause the liquid nitrogen to rise above a gasification point which is near 0° F. so that the output from the heat exchanger is gaseous nitrogen. A gas line 76 can then return a portion of the gaseous nitrogen through the valve 78 back into the return line 80 which enables some of the gaseous nitrogen to be returned into the top of the nitrogen tank 32, if and when desired. The output of the heat exchanger 40 is also coupled into one end of the coiled tubing illustrated in the box 82 through as many valves as are necessary for turning the nitrogen on or off to the coiled tubing 82. One such control valve is illustrated as valve 84. The valve 84 would preferably be a three-way valve which can either cut the gaseous nitrogen off so that it would not flow either into the coiled tubing or the valve 78 or would flow into only one or the other of the coiled tubing 82 and the valve 78.

A hydraulic pump 90 is connected into a hydraulic motor 92 which is used to drive the chains of the injector 44 which can either move the coiled tubing into the well being treated or pull the coiled tubing out of the well being treated, as desired, depending on the direction of the chain rotation.

Another hydraulic pump 96 drives a motor 98 to drive the crane 46 illustrated in FIG. 2.

Another hydraulic pump 100 drives a motor 102 which in turn drives any one or more miscellaneous items requiring a hydraulic activation as desired.

It should be appreciated that the tractor engine 70 drives each of the hydraulic pumps 64, 90, 96 and 100 as shown by the line 106. Coming off of the tractor engine 70, the hydraulic pump 64, 90, 96 and 100 are preferably driven by one or more belts which can be used with clutch pulleys as desired. A compressor unit 108 which is also driven by the tractor engine 70 is run off of the drive line 106 to assist in keeping the liquid nitrogen down to its desired temperature.

It should be appreciated that while the tractor engine 70 is obviously and desirably located on the tractor, and the coiled tubing, the injector, and the crane, as well as the liquid nitrogen tank 32 are preferably located on the tractor, most of the other items identified in FIG. 3 can be found on either the tractor and/or the trailer as desired. The important feature of this invention is to recognize that all of the items shown in FIG. 3 are located on a combined tractor/trailer configuration which does not require the use of either another tractor or another trailer.

Figure 4:
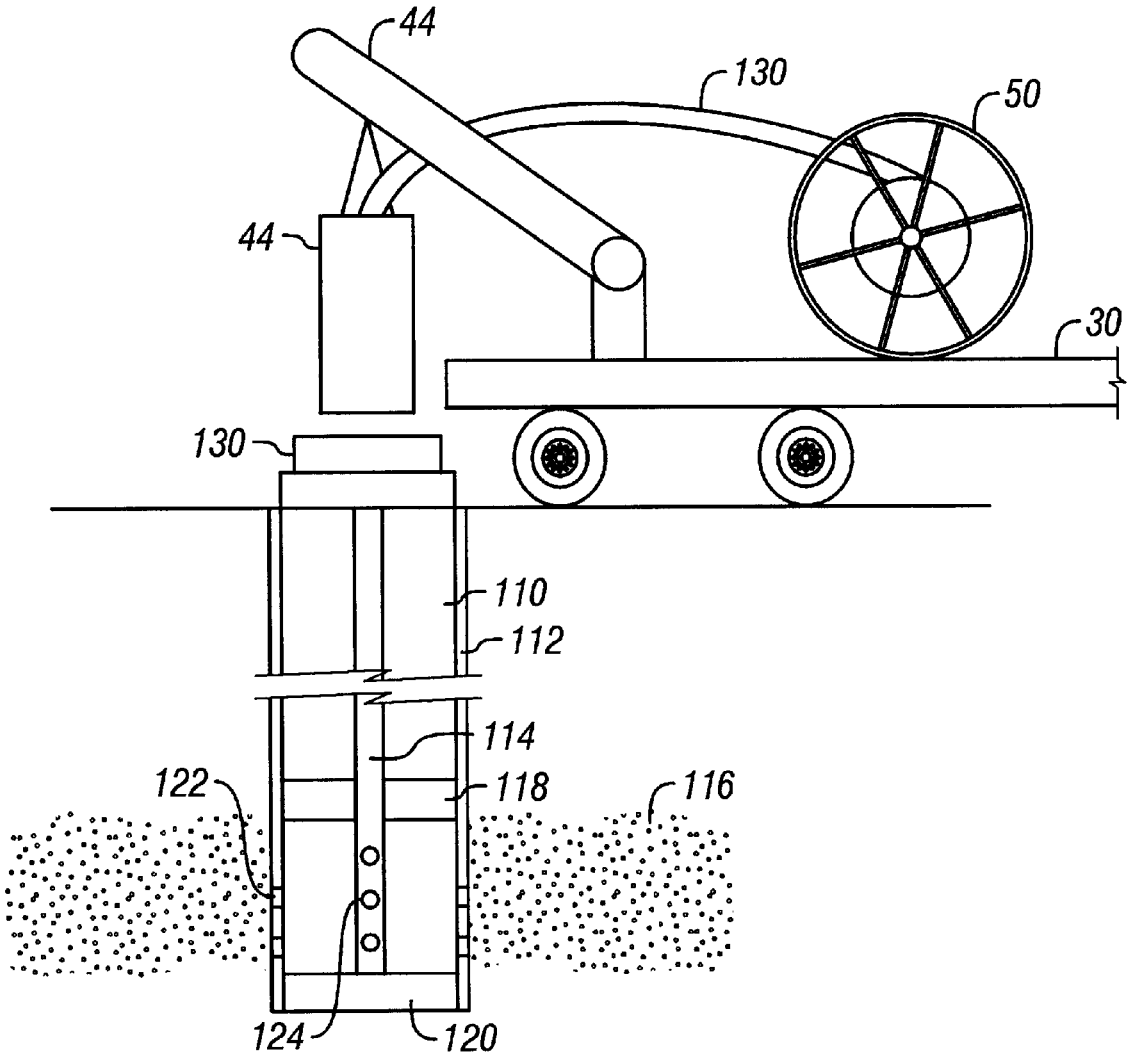
FIG. 4 is an elevated, diagrammatic view of an oil or gas well which is being treated with nitrogen from the coiled tubing unit in accordance with the present invention.

Referring now to FIG. 4, there is a simplified schematic illustrating the process contemplated by this invention for treating a producing oil or gas well which has, for whatever the reason, either quit producing or has started producing with a reduced volume of oil or gas. The tractor trailer illustrated in FIGS. 1 and 2 is delivered to the site of the well 110 which typically is cased with steel casing 112 and which has a string of production tubing 114 running down to the pay zone 116 in the surrounding formation and which has a pair of packers 118 and 120 which straddle the pay zone. With such wells, the casing 112 has a plurality of perforations 122 which enable the oil or the gas to leave the pay zone and come into the interior of the well. The production tubing 114 has a screen or other holes in it 124 which allow the oil or gas to leave the pay zone 116, come through the perforations 122 and enter the production tubing 114 which then allows the oil or gas to travel to the earth's surface.

There are various things which can cause the well in question to quit producing at a rate which it has been experiencing before. There can be sand which enters through the perforations and the holes in the production tubing which plug it up substantially and reduce the amount of oil or gas being produced. Another problem which exists in addition to the sanding problem is the existence of water which may be sitting on top of the oil or gas being produced. Since many of the pay zones contain water, and because of the weight of the water sitting on top of the oil or gas being produced, the oil or gas simply will not proceed up to the surface. To overcome either one of these problems, it is desirable to pump gaseous nitrogen down through the production tubing 114 to push the sand and/or the water out of the production tubing string 114 and back up through the annulus between the steel casing and the production tubing. This can be accomplished either by not using the production packer 118 or by having bypass valves which pass through the production packer 118 and allow the sand and/or the water to be produced up the annulus through the earth's surface and once again, place the production of the pay zone back to what it was before the problem occurred. In an alternative mode, the packer 118 can remain in the cased borehole as illustrated, unbypassed, and the gaseous nitrogen when bubbled out of the end of the coiled tubing beneath the perforations, will drive sand and/or the water back to the earth's surface through the production tubing itself.

To accomplish all of this, it is desirable that the gaseous nitrogen be introduced from the earth's surface by passing the gaseous nitrogen through the coiled tubing from the coiled tubing reel located on the bed of the tractor. To get the coiled tubing 130 into the interior of the production tubing string 114, the coiled tubing injector 44 is moved by the crane unit 46 to be immediately above the Christmas Tree 130 which is, of course, the well-known oilfield apparatus which is placed at the top of the producing well 110. The coiled tubing 130 is run through a well-known stripper into the interior of the Christmas Tree 130 and enters the interior of the production tubing string 114 without causing any leaks of any substance within the well to be vented into the atmosphere. The gaseous nitrogen is then caused to exit the lower end of the coiled tubing 130, usually as the coiled tubing is being pushed into the production tubing, or can be turned on after the coiled tubing is in place in the well, if desired. The gaseous nitrogen then causes any water and/or sand which is plugging up the system to be routed through the annulus between the production tubing and the casing to cause the sand and/or the water to be removed from the system, which allows the well to again become productive. While the injector system 44 is shown in block diagram, such injector systems are well-known in the art as described and illustrated in U.S. Pat. No. 5,566,764, the disclosure of Which is incorporated herein by reference. Such systems normally involve the use of one or two rotating chains which can be caused to rotate in one direction to grab a hold of the coiled tubing and inject it into the tubing within the well, or by reversing the direction of the motor, the tubing can be pulled out of the well. As illustrated in FIG. 3, the hydraulic pump 90 drives the motor 92 which causes the one or more chains to rotate within the injector 44, for example, as illustrated with respect to the aforementioned U.S. Pat. No. 5,566,764.

Figure 5:
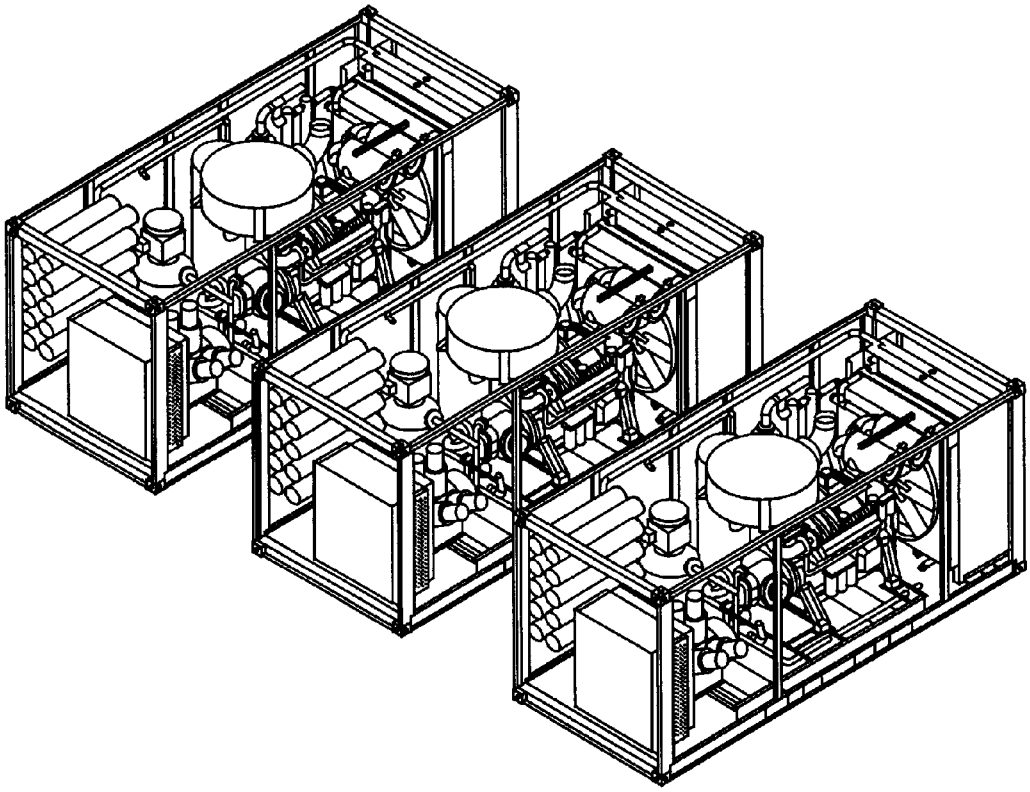
FIG. 5 is a pictorial view of three nitrogen generators which can be used as a substitute for the liquid nitrogen tank.
Figure 6:
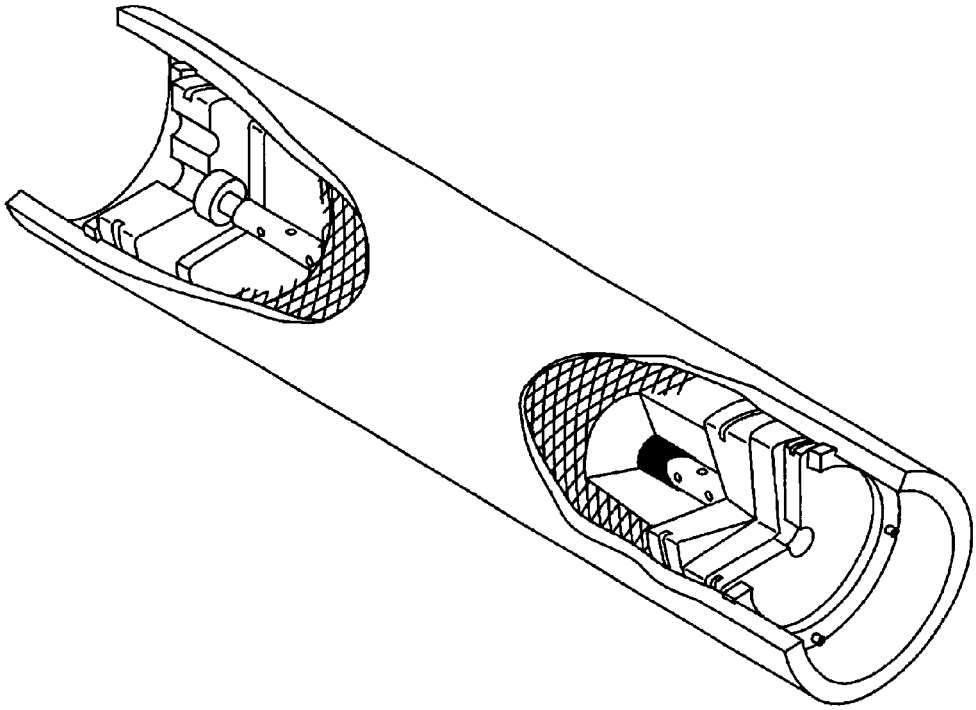
FIG. 6 is a pictorial view of a unit using membrane technology to pull gaseous nitrogen out of the atmosphere.

It should be appreciated that although the present invention contemplates using the liquid nitrogen tank 32 illustrated on the trailer 20 to generate gaseous nitrogen, the invention also contemplates that instead of using the tank 32 illustrated in FIG. 2 as a source of liquid nitrogen, there are additional sources which can be utilized. For example, nitrogen generators can be used, shown in FIG. 5, which extract nitrogen from the atmosphere which can eliminate the costs of transporting and filling nitrogen tanks. Some of such nitrogen generators utilize a membrane, shown in FIG. 6, which allows nitrogen-rich air from the earth's atmosphere to be continuously fed into bundle housing. The air reaches the center of the bundle of membrane fibers which at that point, consists mostly of gaseous nitrogen. The nitrogen collects in the mandrel at the center of the bundle. As the air passes through the bundle of membrane fibers, the oxygen and other fast gases pass through the wall of the membrane fibers as they go through the fibers to be collected at the end. Oxygen and the other fast gases are continuously collected and are moved from the bundle, thus leaving the nitrogen available to be used for injection into the well being treated. By stacking a plurality of such nitrogen generators, available volumes are provided which have an increased flow capability.

Figure 7:
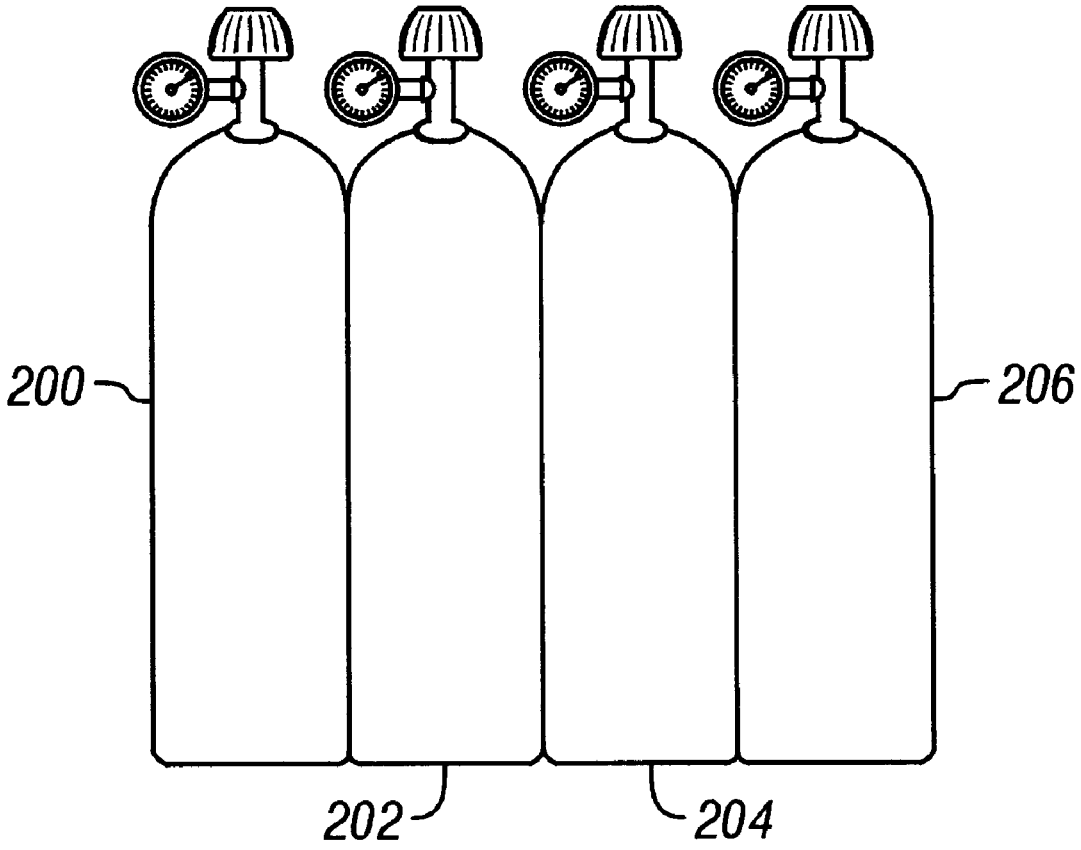
FIG. 7 is an elevated pictorial view of a plurality of tanks used for storing compressed nitrogen gas.

In an alternative mode, albeit not as preferred as either the liquid nitrogen or the nitrogen generator modes, the gaseous nitrogen source can be one or more tanks of compressed nitrogen gas such as the tanks 200, 202, 204 and 206 illustrated in FIG. 7.

What is claimed is:

1. A combined system for treating an oil and/or gas well, comprising:

a single tractor having an one engine for moving itself and for pulling a single tractor, said single tractor and said single trailer having together mounted thereon:

a reel of coiled tubing;

a coiled tubing injection unit;

a crane for picking up and lowering said coiled tubing injection unit; and a tank of liquid nitrogen, said coiled tubing injection unit, said crane and said tank of liquid nitrogen each being responsive to the operation of said engine.

2. The system according to claim 1, including in addition thereto, a first hydraulic pump driven by said engine of said tractor for manipulating said coiled tubing injection unit.

3. The system according to claim 2, including in addition thereto, a second hydraulic pump driven by said engine of said tractor for manipulating said crane.

4. The system according to claim 3, including in addition thereto, a third hydraulic pump driven by said engine of said tractor for manipulating the output of said tank of liquid nitrogen.

5. A combined system for treating an oil and/or gas well, comprising:

a single tractor having an engine for moving itself and for pulling a single tractor, said single tractor and said single trailer having together mounted thereon:

a reel of coiled tubing;

a coiled tubing injection unit;

a crane for picking up and lowering said coiled tubing injection unit; and a source of gaseous nitrogen, said coiled tubing injection unit, said crane and said source of gaseous nitrogen each being responsive to the operation of said engine.

6. The system according to claim 5, including in addition thereto, a first hydraulic pump driven by said engine of said tractor for manipulating said coiled tubing injection unit.

7. The system according to claim 6, including in addition thereto, a second hydraulic pump driven by said engine of said tractor for manipulating said crane.

8. The system according to claim 7, including in addition thereto, a third hydraulic pump driven by said engine of said tractor for manipulating the output of said source of gaseous nitrogen.

9. The system according to claim 5, wherein said source of gaseous nitrogen is a nitrogen generator which gathers gaseous nitrogen from the earth's atmosphere.

10. The system according to claim 5, wherein said source of gaseous nitrogen comprises at least one tank of compressed nitrogen gas.

11. The system according to claim 5, wherein said source of gaseous nitrogen comprises a plurality of tanks of compressed nitrogen gas.

* * * * *

UNITED STATES PATENT AND TRADEMARK OFFICE

CERTIFICATE OF CORRECTION

PATENT NO. : 6,702,011 B2
DATED : March 9, 2004
INVENTOR(S) : James B. Crawford and Edward R. Lamb It is certified that error appears in the above-identified patent and that said Letters Patent is hereby corrected as shown below:

Column 5,
Line 16, after "having an" please delete "one"
Line 17, after "for pulling a single" please replace "tractor" with -- trailer --.

Column 6,
Line 4, after "pulling a single" please replace "tractor" with -- trailer --.

Signed and Sealed this

Fifth Day of October, 2004

JON W. DUDAS
*Director of the United States Patent and Trademark Office*